US005692929A

United States Patent [19]

Hoffmann

[11] Patent Number: 5,692,929

[45] Date of Patent: Dec. 2, 1997

[54] HOUSING FOR ELECTRICAL CONNECTORS HAVING A SECONDARY LOCKING SYSTEM

[75] Inventor: Manfred Hoffmann, Reichenschwand, Germany

[73] Assignee: Framatome Connectors International, Paris La Defense, France

[21] Appl. No.: 422,895

[22] Filed: Apr. 17, 1995

[30] Foreign Application Priority Data

Apr. 21, 1994 [DE] Germany ..... 44 13 936.5

[51] Int. Cl.[6] ..... H01R 13/514

[52] U.S. Cl. ..... 439/752

[58] Field of Search ..... 439/752, 595, 439/733.1

[56] References Cited

U.S. PATENT DOCUMENTS

| | | | |
|---|---|---|---|
| 5,147,222 | 9/1992 | Hotea et al. | 439/752 X |
| 5,256,084 | 10/1993 | Kodama | 439/752 X |
| 5,376,013 | 12/1994 | Sawada | 439/595 X |
| 5,378,176 | 1/1995 | Sasai | 439/752 O |
| 5,389,014 | 2/1995 | Kumpel et al. | 439/752 O |

FOREIGN PATENT DOCUMENTS

| | | |
|---|---|---|
| 007 709 | 9/1981 | European Pat. Off. . |
| 3633358 | 4/1988 | Germany . |

*Primary Examiner*—P. Austin Bradley
*Assistant Examiner*—Daniel Wittels
*Attorney, Agent, or Firm*—Pollock, Vande Sande & Priddy

[57] ABSTRACT

A housing box for electrical connectors comprising: an arrangement of recesses (1) for receiving electrical contacts (2), and a secondary locking system (5) for the electrical contacts (2), such system engaging transversely behind the cylindrical envelope (12) of the contacts (2) in the recesses (1) in order to lock the contacts axially. The arrangement of the recesses (1) forms a central tower (3) in the housing. The secondary locking system (5) has a base (6) so disposed on the tower (3) as to be movable transversely to the axis of the contact between a first position in which retaining lugs (7) on the top edge of the base (6) are clear of the recesses (1), and a second position in which the retaining lugs (7) lock the electrical contacts (2) in the recesses (1).

8 Claims, 2 Drawing Sheets

HOUSING FOR ELECTRICAL CONNECTORS HAVING A SECONDARY LOCKING SYSTEM

FIELD OF THE INVENTION

This invention relates to a housing for electrical connectors having a secondary locking system.

BACKGROUND OF THE INVENTION

Housings of this kind are known, for example, from EP-0 007 709, which discloses a housing having a secondary locking system in which electrical spring contacts assembled in recesses in the housing are additionally secured against being pulled out to the rear. To this end, the contact recesses are in two halves and, after assembly of the push contacts, these halves are offset laterally from the connector axis. To facilitate offsetting, the recesses of the box half remote from the plug-in side are of larger internal diameter and only the bottom end of the recesses of the latter half is of reduced recess diameter, so that wedges are formed in the region of the intermediate walls between the recesses and, after the engagement of the secondary locking system, these wedges engage in corresponding notches in the plug to be locked.

In this construction, the locking of the connector contacts impairs the ability of the entire housing to withstand bending since the housing is divided in two perpendicularly to the plug-in axis substantially in its center-plane, and is held together only by catch means. When a force acts on the housing perpendicularly to the plug-in direction, for instance, due to a pull on the cable, the connector halves may disengage from their locking and give the contacts an undefined release.

Also known is a secondary locking system wherein, after assembly of the contacts, a locking element is moved in the plug-in direction from a pre-locking pre-catch position into a locking position. Since the plug-in direction is the same as the assembly direction for the contacts, the secondary locking system may become operative accidentally during or before the assembly step, so that the contact-receiving recesses are locked before the contacts have been assembled in them. Accidental locking or catching may also occur during transport of the housing, for example, because of rough handling of a crate so that it hits the ground hard, and acceleration forces may unlock the secondary locking elements during transport. Since it is a difficult job requiring special tools to release secondary locking systems from the lock position, entire batches of housing may be made unsuitable for automatic assembly because of premature lockings.

SUMMARY OF THE INVENTION

It is an object of this invention to provide a housing for electrical connectors which has a reliable secondary locking system which will not become locked accidentally during transport nor during the assembly of contacts before the same have been assembled in their recesses.

The housing according to the invention has a secondary locking system which can take up two clearly defined positions. The movement between the two positions takes place in a direction perpendicular to the assembly and plug-in direction inside the rigid housing. The risk of accidental locking is therefore substantially excluded, and the ability of the housing to withstand forces acting on it from any direction is not impaired.

The locking system can be actuated readily and reliably. The overcoming of a stud or the like and the engagement in the locking position also gives clear information about whether the locked state has actually been reached.

BRIEF DESCRIPTION OF THE DRAWINGS

An embodiment of the invention will be described in greater detail hereinafter, reference being made to the drawings, wherein.

DETAILED DESCRIPTION

Figure 1:
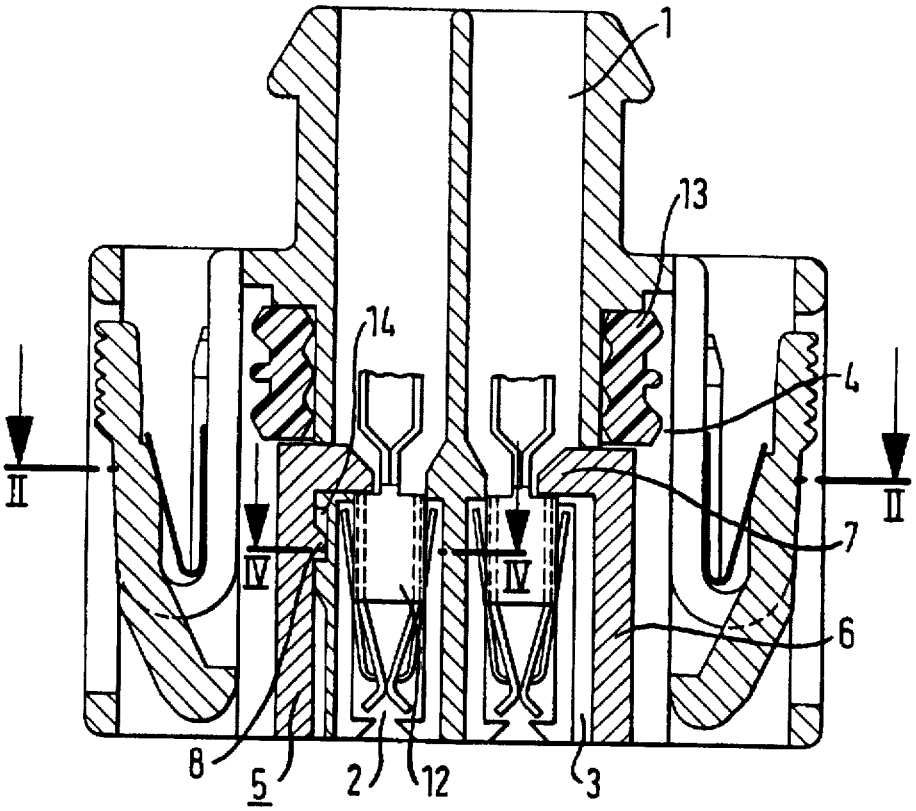
FIG. 1 is a longitudinal section through an embodiment of a housing according to the invention which has a secondary locking system.

FIG. 1 is a view in longitudinal section of an embodiment of the housing according to the invention. Two recesses for connector contacts 2 are present inside the housing. The recesses are combined to form a tower 3 surrounded by an annular gap bounded by the outer walls of the tower 3, the inner walls of the outer casing wall and the base of the annular gap which is at the height of the plug-in side of the housing.

The secondary locking system 5 is disposed in the gap 4. It comprises a base 6 on whose top edge retaining lugs 7 are disposed. The system 5 is movable relatively to the tower 3 and perpendicularly to the plug-in axis between a first position in which the lugs 7 are clear of the contact-receiving recesses so that the contacts can be moved into their end position, and a second position in which the lugs 7 partially close the recesses behind the inserted contacts so that the same cannot release to the rear from their end position.

Figure 4:
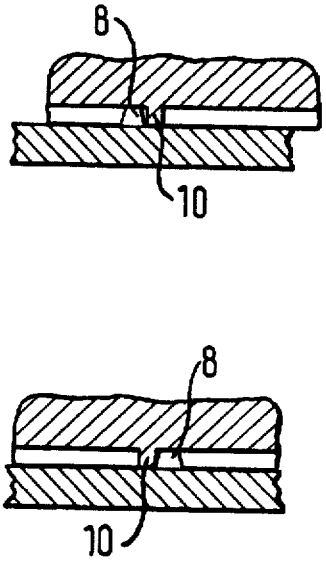
FIG. 4 is a section on the line IV—IV of FIG. 1.

The movement of the system 5 is ensured by appropriate guiding of a stud 8 or the like in a groove 14 in the tower outer wall. Disposed in the groove 14 is a rib 10 which the base 6 of the system 5 abuts in a prelocking position. To actuate the system 5, the base 6 must be deformed resiliently for the stud 8 to overcome the rib 10 in order then to be secured against release in the groove 14. FIG. 4, which is a view on the section line IV—IV of FIG. 1, shows the prelocking position and the locked position of the secondary locking system 5 according to the invention.

Figure 2:
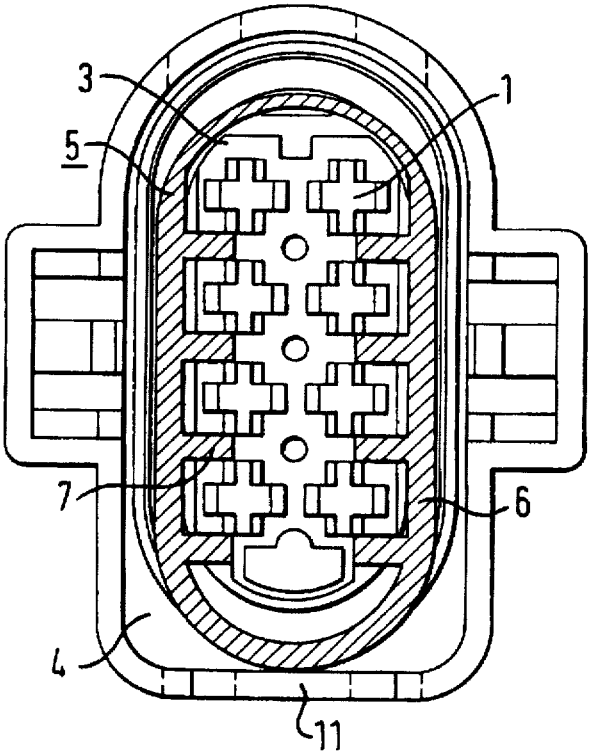
FIG. 2 is a cross-section on the line II—II of FIG. 1 in the prelocking position.
Figure 3:
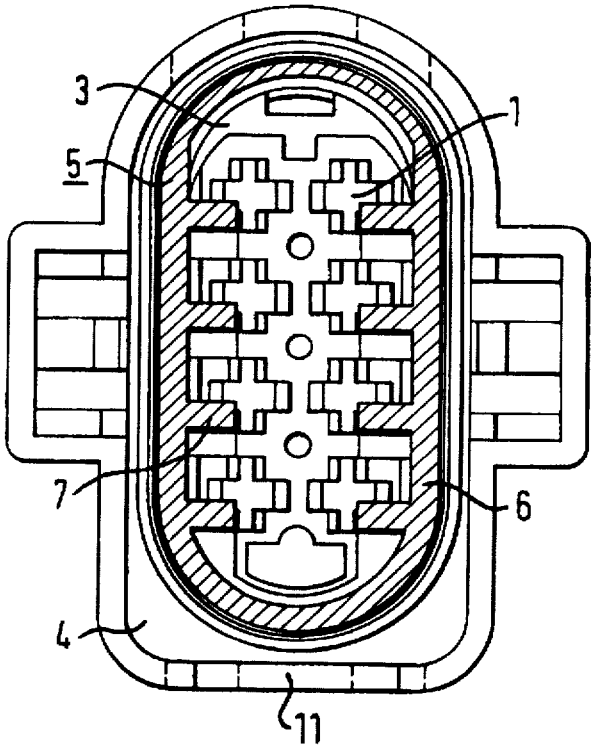
FIG. 3 is a section similar to FIG. 2 in the caught position.

FIG. 2 is a view of the housing according to the invention in section on the line II—II of FIG. 1, and shows the base 6 with the retaining lugs 7 in the annular gap 4 which extends around the tower 3 in the housing. In FIG. 2 the lugs 7 are clear of the recesses 1, so that the contacts 2 can be assembled therein. The secondary locking system is therefore in the prelocking position in FIG. 2. After insertion of the contacts 2 in the corresponding recesses 1 the secondary locking system 5 is moved through the opening 11 in the housing, by slight pressure on the base 6, into the locked position of FIG. 3. In a typical embodiment the locking travel is 1.6 mm. The lugs 7 overlap the apertures of the recesses 1 to some extent so that in response to axial loading in the direction of the connector cable the cylindrical envelope 12 has its rear end face pressed against the lug 7 and is prevented from sliding out of the recess 1.

As shown in FIG. 1., a sealing ring 13 is disposed above the system 5 and ensures complete sealing-tightness of the appliance connection side of the housing in respect of the cable-side part thereof.

The housing according to the invention represents a reliable stable solution for the secondary locking of plug-in contacts in the housing. Accidental locking before insertion of the contacts is virtually impossible, and thus automatic assembly of contacts in the housings causes no problems. The stability of the complete housing is not impaired by the provision of the secondary locking system according to the invention.

I claim:

1. An electrical connector housing with a central tower inside said housing comprising recesses for receiving electrical contacts;

a secondary locking system completely contained inside said housing for said contacts, said system engaging transversely behind a cylindrical envelope of said contacts in said recesses in order to lock said contacts axially;

said secondary locking system having a base so disposed on said tower as to be movable transversely to an axis of said contacts between a first position in which retaining lugs on a top edge of said base are clear of said recesses, and a second position in which said retaining lugs lock said electrical contacts in said recesses.

2. The electrical connector housing according to claim 1 wherein, in said first position, said system engages, by way of a stud, a rib on said tower and by resilient deformation of said base due to lateral pressure thereagainst overcomes the rib in order to lock in said second position.

3. The electrical connector housing according to claim 1, wherein said box has a lateral aperture at a height of said base for displacement of said system from said first position to said second position.

4. The electrical connector housing according to claim 1, wherein said system is pressed to a bottom of an annular gap around said tower by a sealing ring disposed on a top edge of the system.

5. The electrical connector housing according to claim 1, wherein said tower and said base are of substantially oval cross-section, said retaining lugs being disposed on a top edge of said base in two rows parallel to a displacement direction.

6. The electrical connector housing according to claim 1, wherein the stud is guided in a groove in a wall of said tower in a displacement direction.

7. An electrical connector housing with a central tower inside said housing comprising recesses for receiving electrical contacts;

a secondary locking system completely contained inside said housing for said contacts, said system engaging transversely behind a cylindrical envelope of said contacts in said recesses in order to lock said contacts axially;

said secondary locking system having a base so disposed on said tower as to be movable transversely to an axis of said contacts between a first position in which retaining lugs on a top edge of said base are clear of said recesses, and a second position in which said retaining lugs lock said electrical contacts in said recesses;

wherein said system is pressed to a bottom of an annular gap around said tower by a sealing ring disposed on a top edge of said secondary locking system.

8. An electrical connector housing with a central tower inside said housing comprising recesses for receiving electrical contacts;

a secondary locking system completely contained inside said housing for said contacts, said system engaging transversely behind a cylindrical envelope of said contacts in said recesses in order to lock said contacts axially;

said secondary locking system having a base so disposed on said tower as to be movable transversely to an axis of said contacts between a first position in which retaining lugs on a top edge of said base are clear of said recesses, and a second position in which said retaining lugs lock said electrical contacts in said recesses, wherein the stud is guided in a groove in a wall of said tower in a displacement direction.

* * * * *